US005957382A

United States Patent [19]

Thomas

[11] Patent Number: 5,957,382

[45] Date of Patent: Sep. 28, 1999

[54] FOG GENERATOR

[76] Inventor: Clarence O. Thomas, 4324 S. Braden, Tulsa, Okla. 74135

[21] Appl. No.: 08/949,389

[22] Filed: Oct. 14, 1997

Related U.S. Application Data

[63] Continuation of application No. 08/560,480, Nov. 17, 1995, abandoned.

[51] Int. Cl.[6] ..... H05B 1/02; H05B 3/42

[52] U.S. Cl. ..... 239/135; 239/14.1

[58] Field of Search ..... 239/14.1, 135, 239/138; 219/628–631

[56] References Cited

U.S. PATENT DOCUMENTS

| | | | |
|---|---|---|---|
| 2,070,038 | 2/1937 | Batt | 239/135 |
| 2,219,917 | 10/1940 | Crosair | 239/135 |
| 3,472,455 | 10/1969 | Johnson et al. | 239/135 |
| 3,629,552 | 12/1971 | Edging | 239/135 |
| 3,851,146 | 11/1974 | Bennett | 219/300 |
| 3,986,670 | 10/1976 | Syveson | 239/133 |
| 4,090,668 | 5/1978 | Kochenour | 239/135 |
| 4,222,521 | 9/1980 | Niclson | 239/135 |
| 4,465,922 | 8/1984 | Kolibas | 239/135 |
| 4,764,660 | 8/1988 | Swiutosz | 219/272 |
| 4,818,843 | 4/1989 | Swiatosz | 219/278 |
| 4,836,452 | 6/1989 | Foz | 239/338 |
| 5,156,333 | 10/1992 | Worsfold | 239/2.1 |

*Primary Examiner*—Kevin Weldon
*Attorney, Agent, or Firm*—Norris Mc Laughlin & Marcus; L. P. Brooks

[57] ABSTRACT

A fog generator comprising a pump which delivers under hitch pressure a volatilizable chemical into a centrifuge-heater component which centrifuges and heats the chemical efficiently. The centrifuge forces heavier particles of the volatilizable chemical against highly heated areas of the centrifuge member to provide added pressure to the volatilizable chemical passing through the centrifuge resulting in increased production of ultra-fine fog. One embodiment describes a fog generator which includes an ice chamber through which some of the volatilized chemical may be directed to cool the volatilized chemical passing through ice particles therein and make more effective the production of low-lying fog. To make the use of the ice chamber even more efficient, the ice chamber includes means for efficient removal of water which has accumulated from melted ice.

28 Claims, 5 Drawing Sheets

FOG GENERATOR

This application is a continuation of application Ser. No. 08/560,480, filed Nov. 17, 1995, now abandoned.

FIELD OF THE INVENTION

My invention relates to a unique and efficient fog generator. More particularly, my invention relates to a fog generator for generating artificial fog from volatilizable chemicals. Still more particularly, my invention relates to a fog generator which is particularly unique in that it may generate "common" or ordinary fog, which usually has a tendency to dissipate upwardly rather quickly, and may, if desired, generate "cooled", or ground fog.

BACKGROUND OF THE INVENTION

Traditionally, artificial fog had been generated for special effects by the dispersal of various oil chemicals, such as mineral oil. Mineral oil, regardless of the dispersing method used, eventually resulted in a heavy and dangerous deposit of oil on the immediately surrounding surfaces.

Previous devices which attempted to produce a smoke from mineral oil frequently overheated the incoming oil, causing excessive carbon build up within the heating unit and the outlet of the smoke generating device. Of course, it was obvious that this could seriously affect the efficiency of the entire unit.

I have noted that most prior fog generating devices could operate only in the horizontal position. Also, generally, too many special parts had been used in previous devices which had not been compatible with conveniently available effective components, thus making repair or replacement of component parts difficult. This requirement would certainly add to the cost of the device or even to the cost of operation of the device, if the device had to be out of order while waiting for repair.

Frequently, hazardous chemicals had been added to the operating system in an attempt to enhance the hang time of the fog or smoke which had been produced. A portion of these chemicals would remain in the fog or smoke.

Usually, the existent common ground fog machines have required either dry ice or liquid nitrogen as a coolant for the fog material. These are certainly unsafe and dangerous chemicals to be handling. I have designed my system to be much easier and safer to operate.

I have found the following patents which describe various systems for expelling, producing, or dispersing minute particles by means of pressure release, heat application, supercooling, or by practical combinations of certain principles of physics. The patents I found are the following:

| | | |
|---|---|---|
| U.S. Pat. No. 3,851,146 | Bennett | Nov. 26, 1974 |
| U.S. Pat. No. 3,986,670 | Syveson | Oct. 19, 1976 |
| U.S. Pat. No. 4,764,660 | Swiatosz | Aug. 16, 1988 |
| U.S. Pat. No. 4,818,843 | Swiatosz | Apr. 4, 1989 |
| U.S. Pat. No. 4,836,452 | Fox | Jun. 6, 1989 |
| U.S. Pat. No. 5,186,333 | Worsfold | Oct. 20, 1992 |

U.S. Pat. No. 1,851,146 to Bennett describes an apparatus for providing a superheated vapor from an organic liquid which includes a tubular metal member defining a flow passage for both liquid and gaseous phases of the organic compound. A vapor control member is at one end of the tubular member and a source of organic liquid under pressure is provided at the other end of the tubular member.

Electric current flows through the tubular member to heat the member and provide heat to vaporize the organic liquid.

U.S. Pat. No. 3,986,670 to Syveson describes a hand held electric fogging device connected to an aerosol container of insecticide. The aerosol container is attached to a housing to which is attached a heat shield having a coiled conduit therein. Electrical heating means are positioned in the area of the coil for heating the solution to be expelled. A lever is provided on the housing to control the heat and to control the output of the container.

U.S. Pat. No. 4,764,660 to Swiatosz describes a portable fog generator which includes a metal conduit for transporting the smoke agent material from a reservoir of the fluid to an outlet orifice. The metal conduit also acts as a resistance heater coil and a thermal sensor. A thermocouple used for calibration is electrically isolated from the coil by a beryllium oxide disk. A pump connected to the reservoir supplies fluid under pressure to the conduit. Smoke producing agents are identified as propylene glycol and polyethylene glycol 200.

U.S. Pat. No. 4,818,843 to Swiatosz describes a smoke generator which has a pump positioned in a housing connected to a source of fluid for generating the smoke. A coiled electrical resistance heating tube has a thin coating of electrical insulating, thermal conducting material, such as boron nitride. The heating tube has one end connected to the pump and the other end forming an outlet for any vapors generated.

U.S. Pat. No. 4,836,452 to Fox describes an artificial fog generator provided with air jet pipes, oil bath, and filtering screens within a housing. An air compressor supplies high pressure air to the device. High pressure air is supplied through the jet pipes above the oil bath and clouds of fine oil bubbles are passed through the filtering screens and then through the outlets.

U.S. Pat. No. 5,156,333 to Worsfold describes a method of producing fog by passing air through a dryer unit to remove moisture, cooling the dried air to a temperature below the freezing point of water by passing the air over a heat exchanger containing liquid nitrogen, and then inducing water vapor into the dried and cooled air to produce the fog.

SUMMARY OF THE INVENTION

The primary object of my invention is to provide a fog generator which is efficient, easy to operate, and inexpensive.

Another object of my invention is to provide a fog generator which is capable of producing dry, non-toxic fog which remains existent for an extended period of time.

Another object of my invention is to provide a fog generator which is essentially maintenance free and very easy to repair.

Another object of my invention is that my fog generator is designed to produce fog from inexpensive volatilizable chemicals.

Another object of my invention is to provide a fog generator which is designed to be capable of supercooling the fog producing chemical.

Still another object of my invention is to provide a fog generator which is safe to operate, easy to operate, and easy to control.

I have designed my fog generator so that it may be easy operable with a volatilizable chemical, such as propylene glycol, or other similar fluids, with fog producing properties.

I might describe my system, most generally, as comprising a source of a volatilizable liquid, a pump directing a supply of the volatilizable chemical to a heating component for heating this chemical, and continuing the passage of this chemical to a component which causes the heated volatilized chemical to be divided into small units, or thereby processed into a high pressure gas. This high pressure gas then flows to an orifice of the necessary size to be most suitable, through which orifice it is expelled to the outside atmosphere. The atmospheric pressure causes the emitted gas to expand to form the anticipated white fog or cloud.

As I shall describe my invention hereafter, I have designed my fog generator to produce either a "common", or regular fog, or what I describe as a "ground" fog. My system may be operated to produce either type, as selected, or may be operated to produce both types simultaneously. I prefer to describe these two types of fog as "aerial" fog, instead of the "common" fog, and "ground" fog.

For most activities I prefer the use of propylene glycol as the volatilizable chemical.

One very important feature of my fog generator is that the outlet orifice, whether there is one or more, must be of a proper size. The size range I find most efficient is from 1/32 inch to 1/8 inch. An orifice of the proper size is necessary to provide the optimum fog output and to prevent excessive back pressure.

Of course, I intend for my fog generator to be of a size easily adaptable to the purpose for which it is to be used. For example, I have designed my fog generator to be small enough to be easily portable or large enough to fulfill the purpose required, of even as easily separable as may be necessary.

For my portable system I prefer to contain my entire system, all components, where possible, in a housing, which makes the system easy to move and operate.

For my larger systems, for example, I have found it easiest to provide separate components for the source of fuel, high pressure pump, centrifuge-heater component, and where required, a cooling or refrigerating component.

More specifically, as outlined above, the pressurized chemical flows from a pump to what I described as a centrifuge-heater component preferably maintained in an insulated housing, and then either directly to an orifice for producing "aerial" fog, or from the centrifuge-heater component to a refrigeration component for producing "ground" fog.

I have avoided the use of dangerous dry ice or liquid nitrogen, which have been used in previous fog generators, by the manner in which I have provided for an insulated ice chamber, containing common ice of frozen water, which receives the hot, high-pressured, and centrifuged volatilized chemical from a centrifuge-heater component. The ice chamber of my system contains small pieces of ice. The flow through the small pieces of ice serves to make the operation more efficient. The resulting fog has been cooled below the atmospheric temperature, and expands across the surrounding floor or level surface more efficiently.

In combination with an ice chamber component I find it necessary, for highest efficiency, to be able to remove water which has accumulated in the bottom of the ice chamber from ice which has melted. I have provided simple means for accomplishing this task.

A most important feature of my fog generator is the component I have described as the centrifuge-heater component. A centrifuge component and a heater component are two units which I prefer to have positioned in close arrangement within an insulated heat sink. In one instance I show a centrifuge component and a heating component positioned separately but close together in a heat sink. In another aspect I show a centrifuge and a heater in very close coordination, they are touching.

I have designed what I call a centrifuge component because the unit to which I refer breaks down particles of volatilized chemical into smaller and smaller particles of the volatilized chemical by centrifuge action upon the volatilized chemical as it flows through the centrifuge. I have noticed the efficiency of this centrifuge effect and I believe it is a result of large particles of the volatilized chemical being centrifuged against outer walls of an archimedean-like spiral component of my device. I have shown at least two different centrifuge components that demonstrate this effect.

Preferably, the centrifuge component of my invention is located within an insulated heat sink of metal or ceramic material that will conduct heat or cold easily and efficiently. The heat sink should be machineable and should not melt even if its temperature should reach 900 degrees Fahrenheit. The mass should be of such quality that it may maintain its involved heat for the required length of time addressed to that particular type of fog generator.

The most efficient operation of my fog generator, that is, the highest production of fog particles of the smallest size, depends greatly upon the most efficient temperature control of the heater component in relation to the size and power of the pump, the type of centrifuge component, and the heat capacity of the heat sink.

Thus, the fog generator of my invention comprises a source of volatilizable chemical which is connected to a pump driven by electrical power. The electric power drives the pump, a centrifuge-heater component, temperature control means, and other necessary control means and various indicator means. The pump applies high pressure to the chemical to drive the volatilizable chemical into and through the centrifuge-heater component. The centrifuge-heater-component adds high heat to the chemical to change the chemical into high pressure gas in coordination with high pressure continually being given to the centrifuge-heater component. As described above, the centrifuge member of the centrifuge-heater component centrifuges heavier particles of the chemical against more highly heated areas of the centrifuge member to provide added pressure to the volatilizable chemical passing through the centrifuge member. The centrifuge-heater component is enclosed within an insulated housing. An orifice connected to the outlet of the centrifuge member provides passage of the volatilizable chemical to the exterior of the fog generator, the orifice being of a size to provide optimum fog output while preventing excessive back pressure within the conditions of the operation of the fog generator.

The above objects and advantages of my invention will become apparent from my description of the following preferred embodiments of my invention.

DESCRIPTION OF THE PREFERRED EMBODIMENTS

Figure 1:
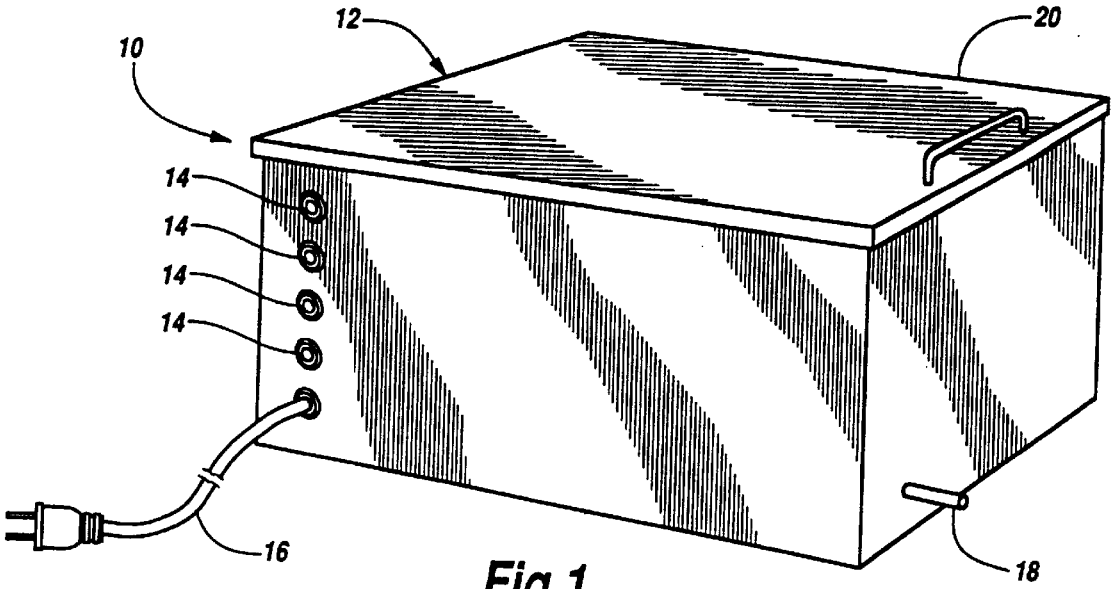
FIG. 1 is a perspective view of a fog generator according to my invention demonstrating the portability of one form of device and illustrating the easy access to its various components within its housing unit.

FIG. 1 illustrates a fog generator 10 according to my invention. This embodiment of my invention is intended to be a portable unit as may be understood because all the components are enclosed within a housing 12. All that is visible in this drawing of a fog generator are a series of electrical controls 14, a power cord 16, an outlet 18 for fog, and a lid 20.

Figure 2:
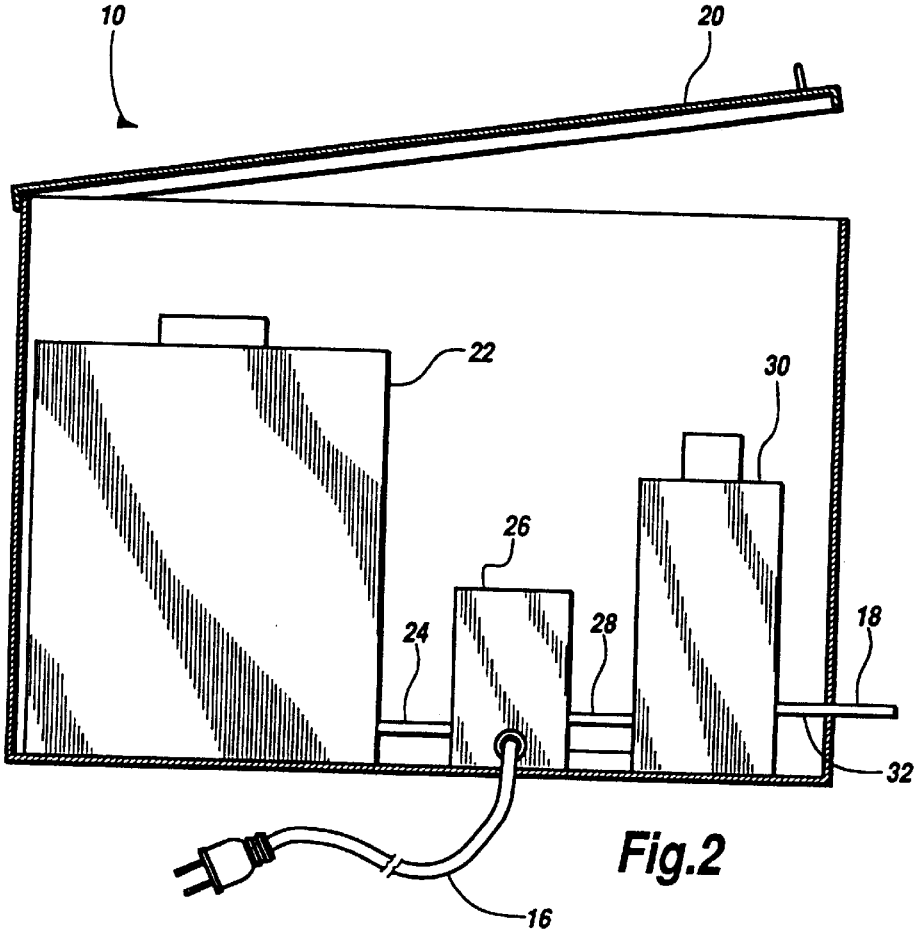
FIG. 2 is a diagram of a fogging generator according to my invention as it would appear as a diagram in side view with a side plate of its housing removed as it would be intended to disperse aerial type fog.

FIG. 2 illustrates an embodiment of my invention as I had shown in FIG. 1, but as a side view with a side panel removed to show the arrangement of inner components. In this FIG. I show a volatilizable chemical container 22, tubing 24 connecting the chemical container to a pump 26 to which the power cord 16 is connected, and tubing 28 connecting pump 26 to a centrifuge-heater component 30. Tubing 32 connects the centrifuge-heater component 30 to outlet 18.

Figure 3:
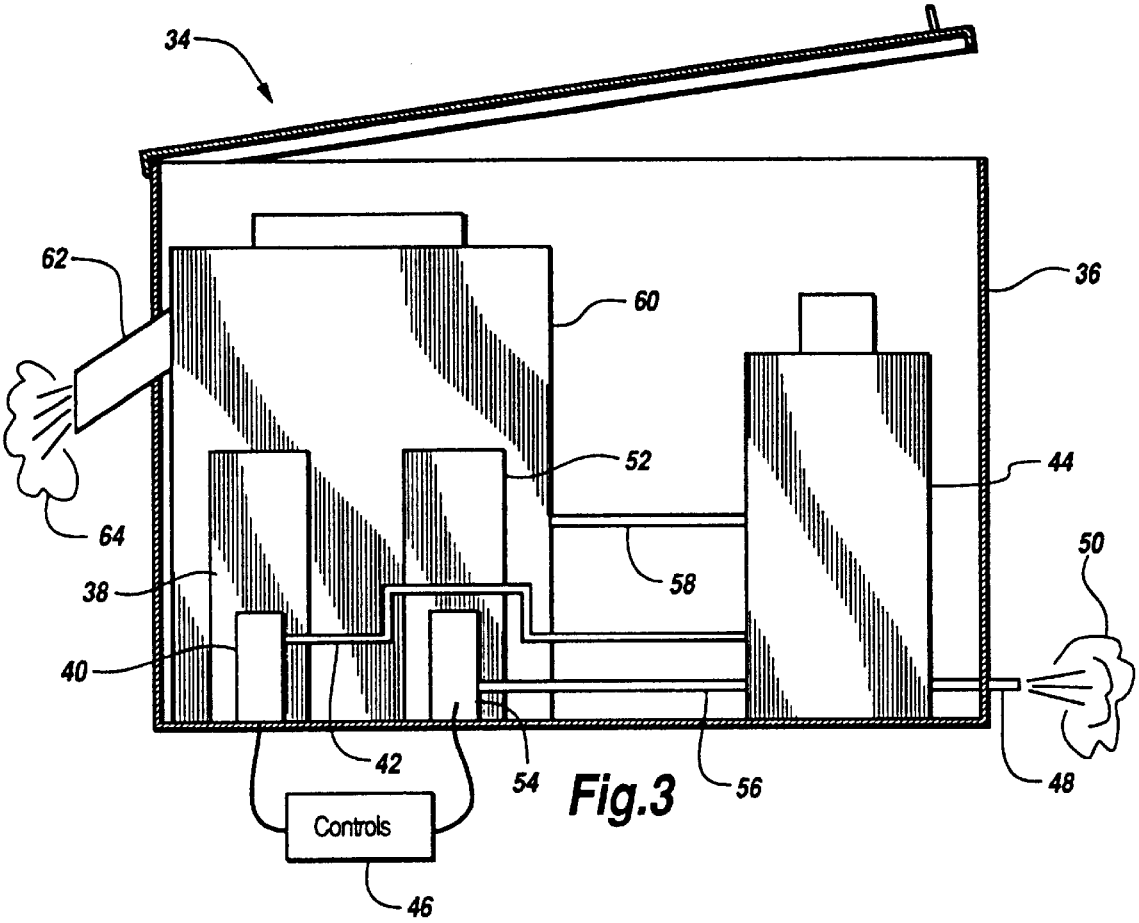
FIG. 3 is a block diagram, similar to FIG. 2, of a fogging generator according to my invention, as it would be intended to disperse either aerial fog or ground fog, or both aerial and ground fog simultaneously.

FIG. 3 illustrates another embodiment of a fog generator 34 according to my invention, which also may be a portable fog generator.

Fog generator 34 includes a housing 36 which contains a source of volatilizable chemical 38 connected to a pump 40 which passes the chemical under high pressure by line 42 to centrifuge-heater 44. Through manipulation of controls 46 I am able to direct this type of fog through outlet 48 as aerial fog 50.

Whenever I choose, I may direct a source of volatilizable chemical from source of chemical 38 through a pump 54, then under high pressure through line 56 to centrifuge 44, and then through line 58 to an ice chamber 60.

As the volatilizable chemical, which is now a gas under high pressure, enters ice chamber 60, it flows through small pieces of ice as I described above, and then, after being properly cooled, the gas passes out an outlet 62 as ground fog 64. As I described above, this type of fog now has a greater tendency to remain close to the lowest level surrounding the fog generator.

Figure 4:
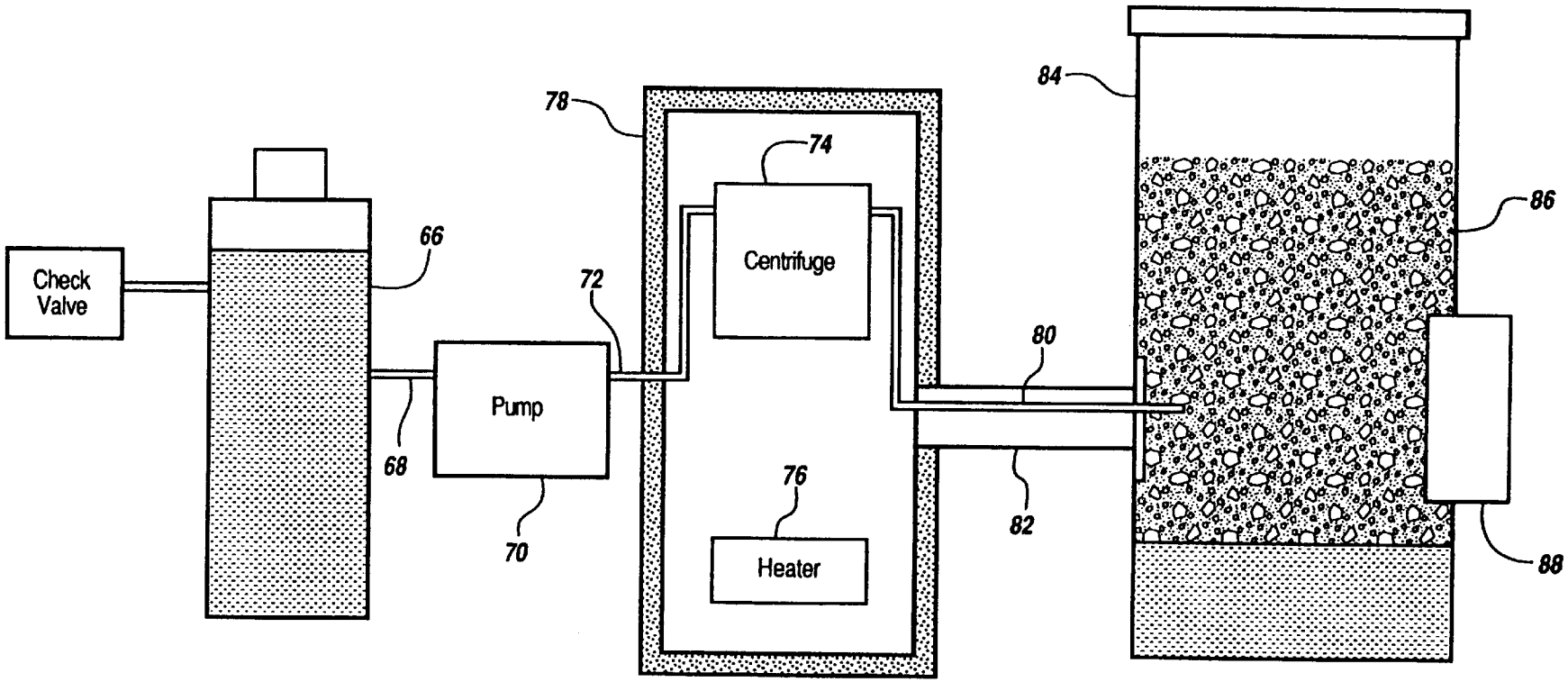
FIG. 4 is a block diagram of a fog generator according to my invention showing the components, some with side plates removed, as various units could be separated and still connected for operation, where conditions of operation require separation of the units.

FIG. 4 illustrates a fog generator according to my invention where the components are shown in side view.

I show a source of volatilizable chemical in a typical container 66 connected by tubing 68 to pump 70 which is connected by line 72 to a centrifuge member 74 which, along with a heater 76, are both contained within an insulated housing 78. It is understood that the electrical components which I had previously shown are a part of this system although they are not shown here. The heater 76 is understood to be connected to and actuated by these controls.

After the heating of the high pressure gas and the centrifuging action that gas, the gas passes through line 80 within tubing 82 to ice chamber 84.

My figure shows clearly the manner in which the chemical must pass through ice particles 86 until the pressurized gas passes through a deflector unit 88 and then to emit as ground fog.

Figure 5:
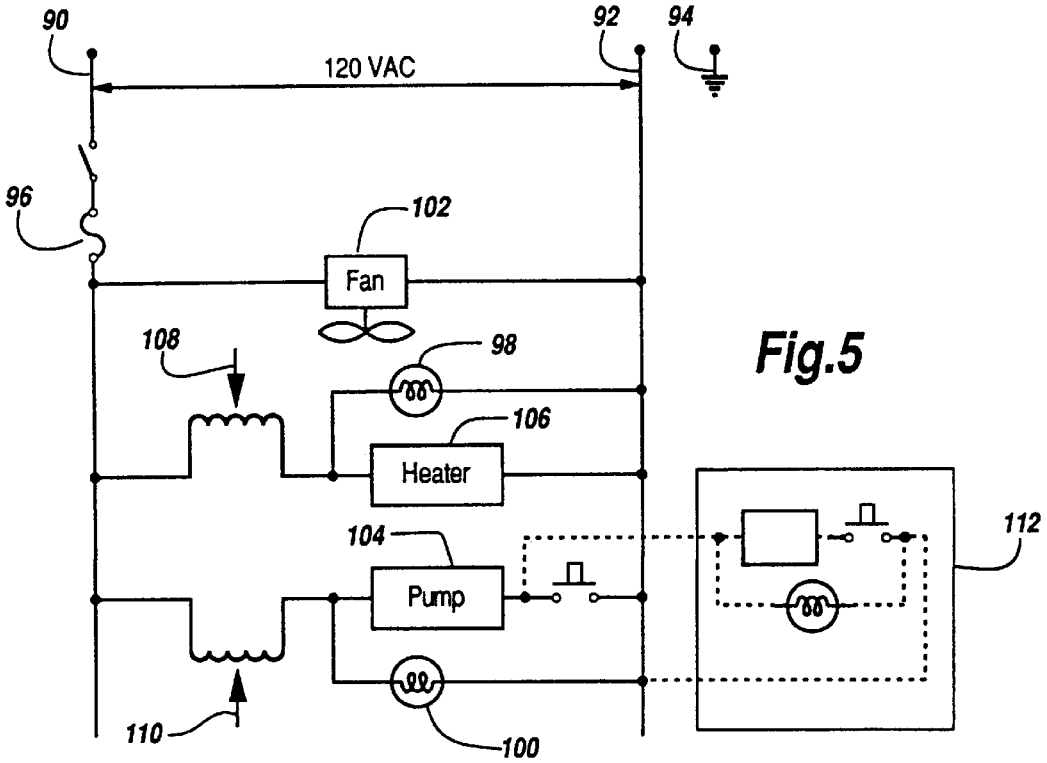
FIG. 5 is a schematic diagram of the electrical circuitry of a fog generator according to my invention.

FIG. 5 shows the simple electrical circuit by which a typical fog generator of my invention could be controlled. The fog generator shown operates on a 120 volt AC circuit. Of course, if necessary, I may easily provide for other power. Electric power to the fog generator is implemented by connection of a suitable connecting member to connect lines 90 and 92 and ground 94. I am able to actuate the power to the fog generator by closing switch 96. Operation of the fog generator is always shown by pilot lights 98 and 100. I might include a fan 102 in my system for better heat control. The circuit operates a pump 104 and heater 106 of the fog generator as they would be operated as described above. I have included for safety measures a heater thermostat 108 and a pump thermostat 110. A remote control unit 112 is provided for further control of the fog generator where it might be convenient.

Figure 6:
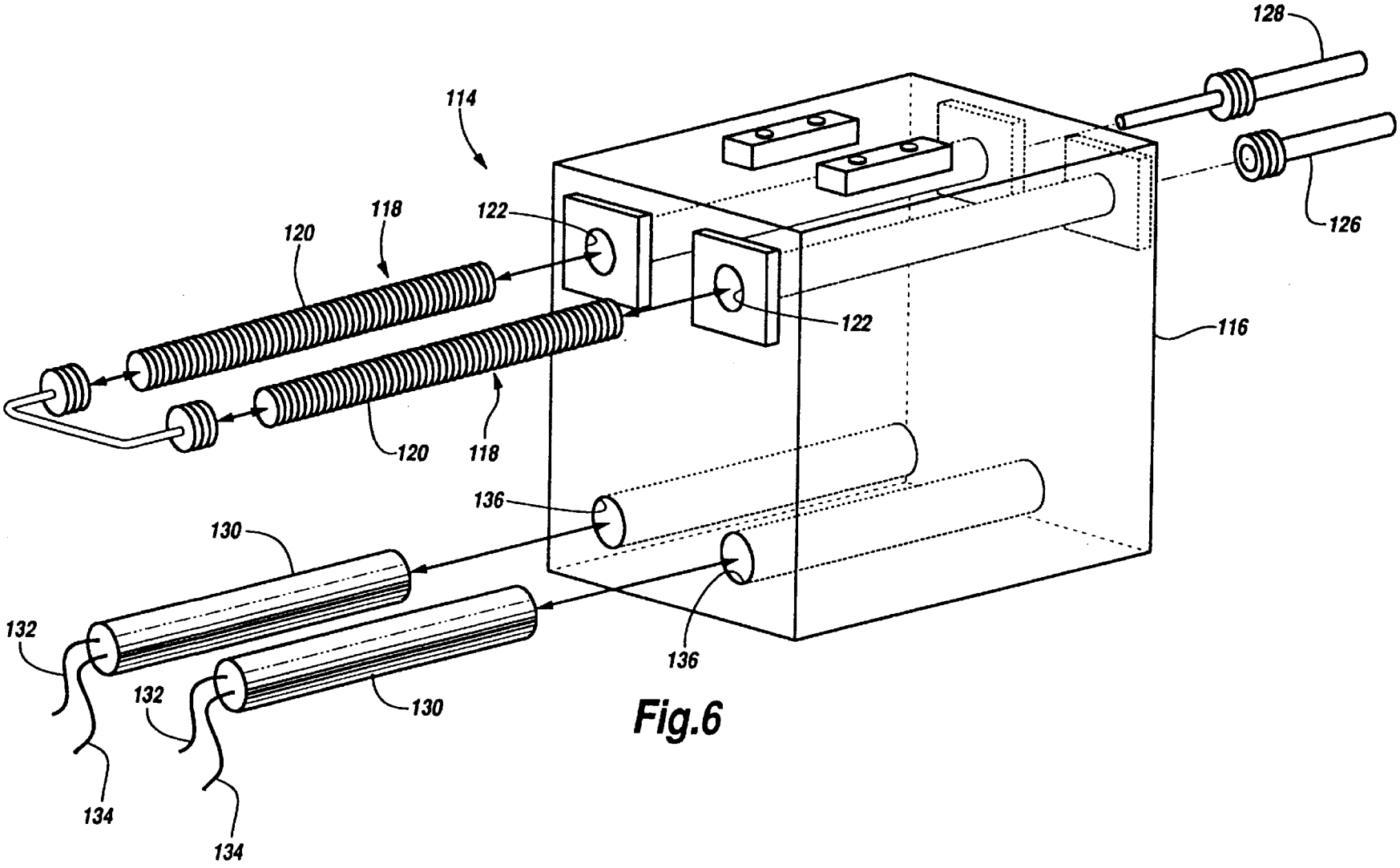
FIG. 6 is an exploded perspective view of a centrifuge-heater component and heat sink unit of my invention showing the heat sink as a metal block.

FIG. 6 illustrates one embodiment of a centrifuge-heater component 114, generally. I have designed the centrifuge-heater component 114 as comprising a metal heat shield 116 which is normally insulated as I described above to preserve heat as efficiently as possible. A centrifuge member 118, generally, shown in exploded manner, comprises a threaded member 120 insertable into a smooth bore 122 of the heat sink 116. In this FIG. I show two centrifuge members 118 which are connected by means of a small tube member 124. The two centrifuge members 118 extend essentially the length of heat sink 116 and operate by connection to inlet member 126 and outlet member 128. Inlet member 126 and outlet member 128 perform the same operation as the inlets and outlets of the centrifuge members I have described above.

Centrifuge-heater component 114 includes a pair of electric cartridge type heating members 130 which are connected to the power lines 132 and 134. Typically, these should provide temperatures of from 440 to 650 degrees Fahrenheit as desired. The cartridge heaters should fit closely into bores 136 for maximum efficiency.

The centrifuge action for this unit is unique. Volatilizable chemical of high pressure is pumped into the centrifuge members 118 and the centrifuge action occurs because of very slight spacing provided between a threaded member and the smooth bore within the heat sink. As I explained above, the chemical eventually becomes gaseous and heavier particles of this gas are thrown against the heated walls of the heat sink, are further heated to increase the already high pressure, and become smaller particles, always forming smaller particles and increasing the pressure as the gas travels through the centrifuge member.

Figure 7:
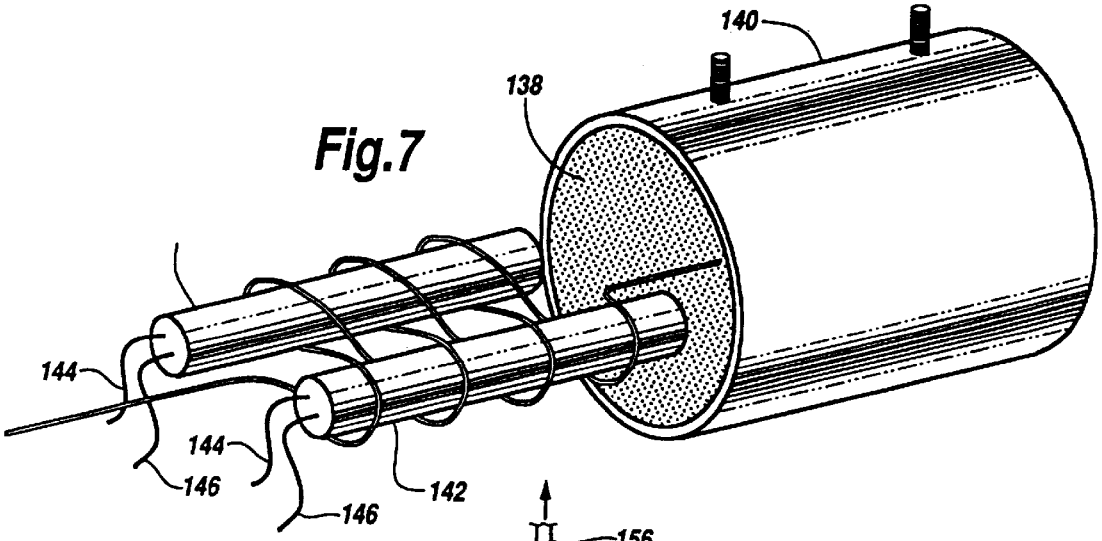
FIG. 7 is an exploded perspective view of a centrifuge-heater component and heat sink of my invention describing a tubular centrifuge and showing the heat sink as a ceramic-type block.

FIG. 7 illustrates an alternate form of centrifuge-heater component. This components, comprises a ceramic heat sink 138 within a metal tube 140.

The centrifuge-heater component comprises a pair of electric cartridge type heaters 142 powered by connection wires 144 and 146. A centrifuge member is established by means of elongated small diameter tubing 148 wrapped helically around or adjacent the heating member 142. One example of this could be the use of ⅛ inch copper tubing and the centrifuge component. The tubing should be wrapped around the heaters for many more turns around the heaters, than shown. The number shown are for convenient display only. The centrifuge effect is provided as described for FIG. 6.

In forming the ceramic heat sink and centrifuge members, they are formed by first lacing the copper tubing around the cartridge heaters, placing these within a 2 ½ inch EMT steel shell, then filling this tube with liquid ceramic material, and firing this to solidify the mass.

Figure 8:
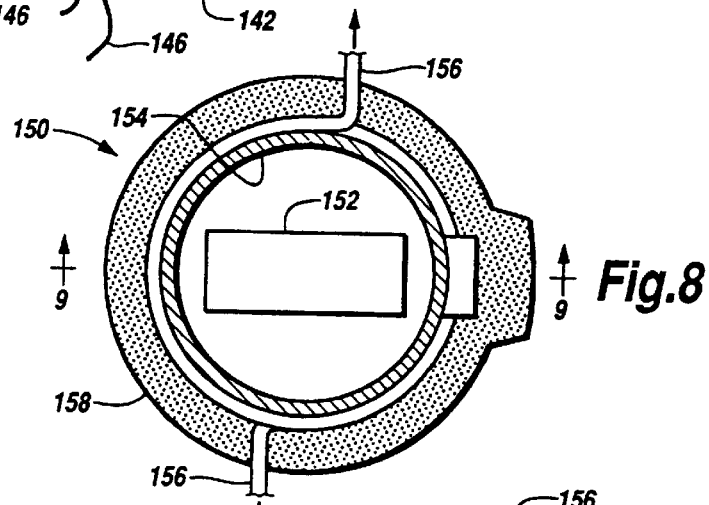
FIG. 8 is a cross-sectional top view of a fuel burner heating component as one embodiment for a centrifuge-heater component according to my invention.
Figure 9:
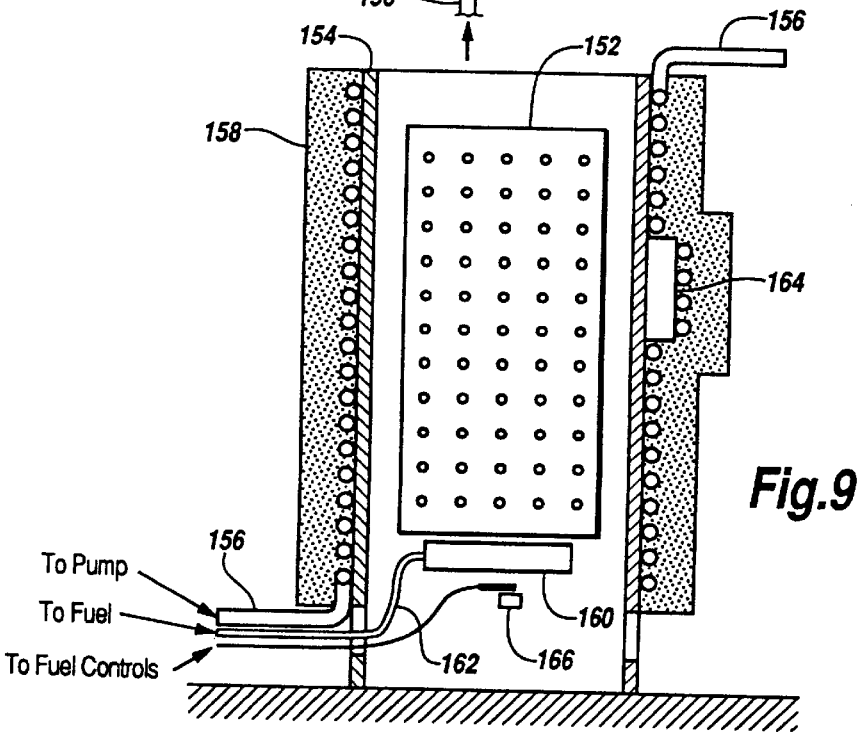
FIG. 9 is a cross-section side view of a fuel burner component according to my invention as shown in FIG. 8 along the lines 9—9 of FIG. 8.

FIGS. 8 and 9 illustrates a fuel type centrifuge heater component 150. A ceramic space heater element 152 is positioned within a metal tubing 154, with small diameter tubing 156 wrapped helically around pipe 154. Thus, tubing 156 is connected to the pump of the fog generator and tubing 156 performs the same centrifuging action as the small diameter tubing does as described above.

Centrifuge-heater 150 includes insulating material 158, a fuel burner 160, a fuel line 162 to supply the burner with fuel, a pump thermostat 164, and a thermocouple 166. The centrifuge action is as I have described above.

I wish to make special note of a form of cooling the high pressure gaseous chemical in some processes, that if the situation should warrant it, I may wish to substitute a small refrigerating unit in my fog generating system instead of the ice chamber I have described. I would then simply direct the flow of high pressure gas over the cold refrigerating coils in the manner I have described above for an ice chamber.

Since many different embodiments of my invention may be made without departing from the spirit and scope thereof, it is to be understood that the specific embodiments described in detail herein are not to be taken in a limiting sense, since the scope of the invention is best defined by the appended claims.

I claim;:

1. An artificial fog generator, comprising:

a source of volatilizable chemical;

a pump;

a centrifuge member having an inlet connected to the pump to receive pressurized volatilizable chemical;

a separate heating member coupled to the centrifuge member to provide high heat to the centrifuge member;

temperature control means connected to the heating member for closely controlling the heating temperature of the heating member;

said centrifuge member having a helical passageway defined by a wall and defining a helical path from the inlet thereof to an outlet thereof for the passage of the volatilizable pressurized chemical from the inlet to the outlet and to centrifuge heavier particles of the volatilizable chemical toward the wall and against more highly heated areas of the centrifuge member to increase the pressure of the volatilizable chemical passing through the centrifuge member;

insulating housing means enclosing the centrifuge member and the heating member; and orifice means connected to the outlet of the centrifuge member for providing passage of volatilizable chemical to the exterior of the fog generator as a fog, and for maintaining the volatilizable chemical under pressure in the passageway but preventing excessive back pressure connected with the conditions of the operation of the fog generator.

2. A fog generator as described in claim 1, wherein the centrifuge member comprises an elongated helically threaded member fitting snugly within a receptacle member with a wall defining a smooth bore, the threads of the threaded member and the wall of said bore defining said helical passageway to provide centrifuge action of the volatilizable chemical.

3. A fog generator as described in claim 2, wherein the receptacle member is a heat conductive metal heat sink member engaging the heating member to transfer heat from the heating member to the wall of said bore and provide efficient distribution and retention of heat.

4. A fog generator as described in claim 3, wherein the heating member comprises an electric cartridge heater.

5. A fog generator as described in claim 1, which includes an ice chamber for receiving water ice and having an inlet connected to the outlet of the centrifuge member to permit volatilized chemical to pass through and in contact with ice material in the ice chamber, the ice chamber having an outlet from which cooled volatilizable chemical is emitted and said ice chamber having means for efficient removal of accumulated water therefrom.

6. A fog generator as described in claim 1, wherein the heating member comprises a fuel burner component.

7. A fog generator as described in claim 2, wherein the receptacle member is a heat conductive ceramic heat sink member engaging the heating member to transfer heat from the heating member to the wall of said bore and provide efficient distribution and retention of heat.

8. A fog generator as described in claim 7, wherein the heating member comprises an electric cartridge heater.

9. A fog generator as described in claim 1, wherein said helical passageway is defined by an elongated small diameter tube wound helically around the heating member.

10. A fog generator as described in claim 9, wherein the heating member comprises an electric cartridge heater.

11. A fog generator as described in claim 10, which includes an ice chamber for receiving water ice and having an inlet connected to the outlet of the centrifuge member to permit volatilized chemical to pass through and in contact with ice material in the ice chamber, the ice chamber having an outlet from which cooled volatilizable chemical is emitted and said ice chamber having means for efficient removal of accumulated water therefrom.

12. A fog generator as described in claim 9, wherein the heating member comprises a fuel burner component.

13. An artificial fog generator comprising:

a source of volatilizable chemical;

a pump having an inlet coupled to said source for receiving said chemical and having an outlet at which the chemical is delivered at a pressure which is high relative to atmospheric pressure;

a centrifuge member having an inlet and an outlet; the inlet of said centrifuge member being coupled to the outlet of said pump for receiving the pressurized chemical from the pump and the centrifuge member having centrifugal force means directing the chemical along a path from the inlet of the centrifuge member to the outlet of the centrifuge member which will cause heavier particles of the chemical to move toward a side of said path;

a separate heating member adjacent and coupled to said centrifugal force means for the supply of heat thereto at a temperature which is high relative to room temperature and for thereby heating the chemical and converting the chemical to a high pressure gas in said path; and orifice means at the outlet of said centrifuge member through which the gas exits for maintaining said gas under pressure in said path and causing the gas to be emitted as a fog from the orifice means.

14. The fog generator of claim 13 further comprising a cooling chamber for cooling the gas to a temperature below room temperature, said cooling chamber having an inlet coupled to said orifice member for receiving the gas emitted by the orifice member and an outlet through which the cooled gas exits.

15. The fog generator of claim 14 wherein the cooling chamber has pieces of water ice therein exposed to and in contact with the gas as the gas is passed from the inlet of the cooling chamber to the outlet of the cooling chamber.

16. The fog generator of claim 15 further comprising a deflector at the outlet of the cooling chamber for directing the cooled gas toward an object.

17. The fog generator of claim 13 wherein the centrifugal force means is a spiral tube, the wall of the bore of the tube defining said path.

18. The fog generator of claim 17 wherein said tube encircles said heating member.

19. The fog generator of claim 18 wherein said heating member is an electrically energizable heater.

20. The fog generator of claim 19 wherein said heating member is coupled to said tube by solid heat conducting means.

21. The fog generator of claim 20 wherein said solid heat conducting means is made of metal.

22. The fog generator of claim 21 wherein said solid heat conducting means is made of an electrically non-conductive material.

23. The fog generator of claim 22 wherein the non-conductive material is a ceramic.

24. The fog generator of claim 23 wherein said heating member comprises a fuel burner and said tube encircles said heating member.

25. The fog generator of claim 17 wherein said heating member is coupled to said tube by solid heat conducting means.

26. The fog generator of claim 13 wherein said centrifuge member has at least one bore with a smooth wall and said centrifugal force means comprises a helically threaded member in said bore, the threads of the threaded member and the wall of the bore defining at least a portion of said path.

27. The fog generator of claim 13 wherein said centrifuge member has a second bore with a wall and wherein said heating member is an electrically energizable heater in said second bore.

28. The fog generator of claim 27 wherein said centrifuge member comprises a ceramic material and said one bore and said second bore are in the ceramic material which couples said heater with the wall of said one bore.

* * * * *